US005725438A

United States Patent [19]

Dennesen

[11] Patent Number: 5,725,438

[45] Date of Patent: Mar. 10, 1998

[54] PRACTICE PUTTING GREEN WITH SIMULATED HAZARDS

[75] Inventor: James J. Dennesen, Hampstead, N.H.

[73] Assignee: Dennco, Inc., Salem, N.H.

[21] Appl. No.: 590,789

[22] Filed: Jan. 24, 1996

[51] Int. Cl.[6] ..... A63B 69/36

[52] U.S. Cl. ..... 473/163; 473/178

[58] Field of Search ..... 473/158, 159, 473/160, 161, 162, 163, 157, 171, 173, 175, 177, 178, 182, 191

[56] References Cited

U.S. PATENT DOCUMENTS

| | | | |
|---|---|---|---|
| D. 83,050 | 1/1931 | Lagaard | 473/158 |
| 1,736,316 | 11/1929 | Lasting | 473/160 |
| 3,558,139 | 1/1971 | Brandell | 473/162 |
| 3,762,718 | 10/1973 | Culley | 473/160 |
| 3,801,107 | 4/1974 | Martin . | |
| 3,814,439 | 6/1974 | Simon . | |
| 3,843,136 | 10/1974 | Buenzle . | |
| 3,844,565 | 10/1974 | Gigliotti | 473/159 |
| 3,856,313 | 12/1974 | Tierney | 473/162 |
| 4,336,939 | 6/1982 | Krumlauf . | |
| 4,850,594 | 7/1989 | Manzione . | |
| 4,928,973 | 5/1990 | Perry et al. . | |
| 4,953,865 | 9/1990 | Coombs et al. . | |
| 4,988,106 | 1/1991 | Coonrod . | |
| 5,011,153 | 4/1991 | Watkins . | |
| 5,082,280 | 1/1992 | Wang . | |
| 5,100,145 | 3/1992 | Kim . | |
| 5,102,141 | 4/1992 | Jordan . | |
| 5,108,101 | 4/1992 | Postula | 473/158 |
| 5,150,904 | 9/1992 | Sindelar . | |
| 5,171,016 | 12/1992 | Kamal . | |
| 5,201,521 | 4/1993 | Healy . | |
| 5,390,926 | 2/1995 | Hanson et al. . | |
| 5,431,403 | 7/1995 | Pelz . | |

*Primary Examiner*—Mark S. Graham
*Attorney, Agent, or Firm*—Choate, Hall & Stewart

[57] ABSTRACT

A golf putting practice green with a conventional golf cup and at least one simulated golf hazard. The practice putting green includes a putting mat with a realistic putting surface, a wedge shaped incline, a conventional golf cup and at least one simulated golf hazard. The golf hole and the hazards are formed from openings in the putting mat and cavities in the incline. The incline, and the golf hole and hazards, are positioned proximate to a distal end of the putting mat. An accurately putted golf ball will successfully enter the golf cup and come to rest underneath the putting mat. An errant putt, on the other hand, may enter one of the simulated hazards which protect the golf cup, but will still come to rest at the same resting place as the accurately putted ball.

4 Claims, 3 Drawing Sheets

PRACTICE PUTTING GREEN WITH SIMULATED HAZARDS

BACKGROUND OF THE INVENTION

This invention relates to an apparatus for use in practicing the skill of putting a golf ball, and more particularly to a portable apparatus to practice sinking the putted ball into a golf cup while avoiding simulated hazards that protect the golf cup.

To score well in the sport of golf, putting skill is required. Nowhere on the golf course is a player's score more affected than on the putting greens. This is because the putter is the most used club in any golfer's bag. In fact, the average golfer generally uses his or her putter at least thirty-six times during a round of golf. A common quip in the sport is that "you drive for show, but you putt for dough."

Another skill necessary to score well is avoiding hazards. The rules of golf provide that entry into a water hazard usually entails a one-stroke penalty. Even if a penalty is not imposed for such entry (a lateral water hazard for example), playing the ball from the water hazard often results in an increased score for the hole. Similarly, golfers try to avoid sand hazards (also commonly referred to as bunkers or sand traps) because they require a special swing and shot, usually resulting in an increased number of strokes. In sum, avoidance of hazards is a fundamental aim in the sport of golf.

To putt well, or in many cases simply to develop putting competence, most golfers require large amounts of practice. A variety of circumstances, such as rain, snow, cold, darkness or want for golf course proximity prevent or inhibit practice outdoors. But, because putting requires a very small area, especially relative to the expanse of an entire golf course, numerous types of indoor practice putting units are utilized. These units range from a drinking glass on a carpet to complicated and expensive systems with special golf green surfaces having multiple holes, adjustable surfaces, and electronic scoring devices. These units generally include some variation of a golf cup at which to aim. Some also include a backstop, side gutters, or some other collection mechanism for the errant (missing the cup) practice shot. These many variations, however, do not provide a simulated golf hazard which allows the golfer to both practice putting into a golf cup and practice the mindset of avoiding hazards along with common ball collection.

It is an object of the present invention to provide a practice putting green for practice and for fun which combines practicing putting a golf ball into a golf cup with practicing the avoidance of golf hazards. It is another object of the present invention to provide a practice putting green which is easily stored.

SUMMARY OF THE INVENTION

The object of the present invention is to provide a golf putting practice green that combines a conventional golf cup with at least one simulated golf hazard. The present invention includes a putting mat with a realistic putting surface, a wedge shaped incline, a conventional golf cup and at least one simulated golf hazard, the hole and hazards are formed from openings in the putting mat and cavities in the incline. An accurately putted golf ball will successfully enter the golf cup. An errant putt, on the other hand, may enter one of the simulated hazards which protect the golf cup.

DETAILED DESCRIPTION OF THE PREFERRED EMBODIMENT

Figure 1:
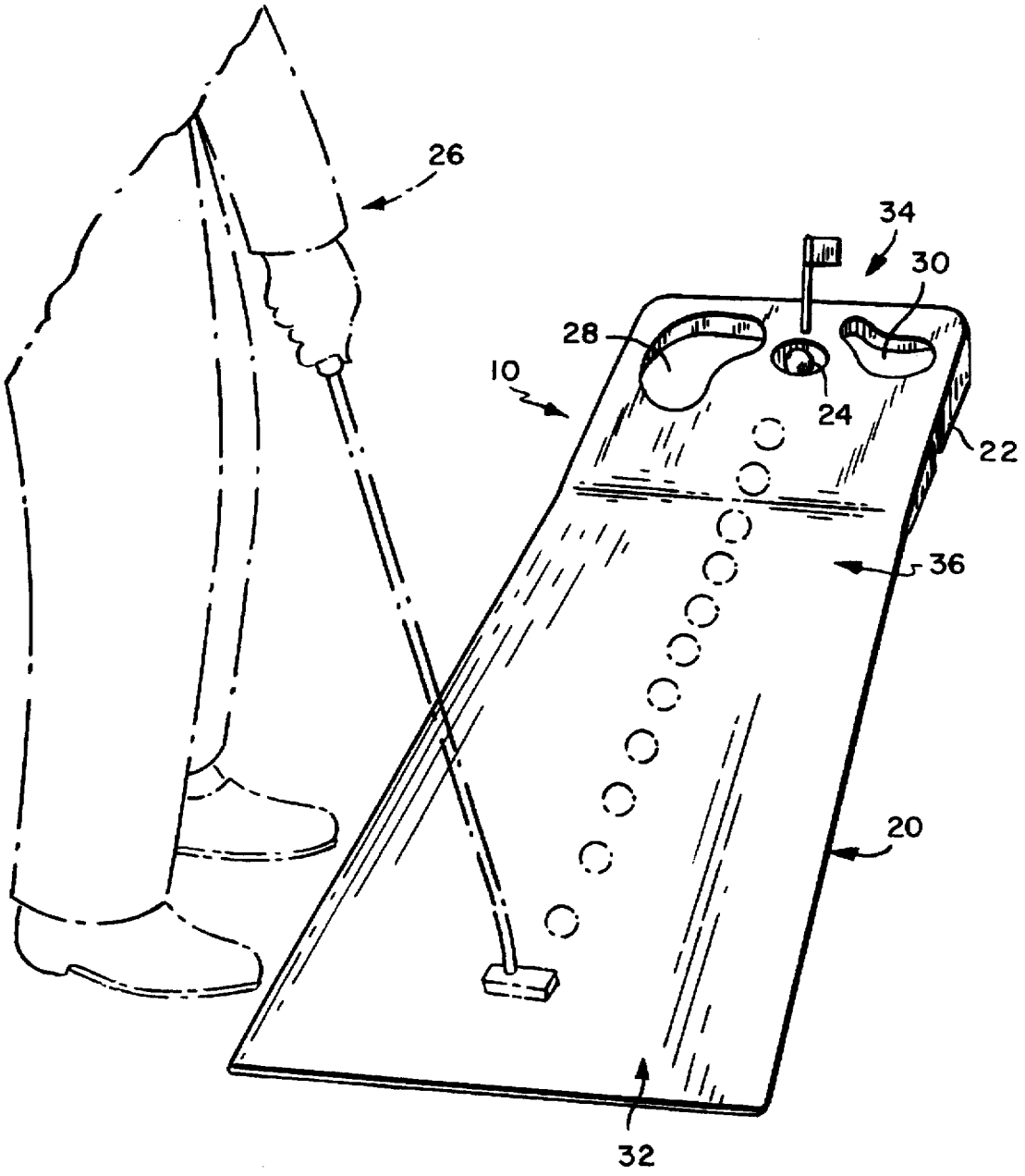
FIG. 1 is a perspective view of a golfer using a practice putting green with simulated hazards in accordance with the present invention.

As shown in FIG. 1, a golf practice putting green is designated generally by reference numeral 10. In the preferred embodiment, the practice putting green 10 is designed to be easily and compactly stored, preferably in the original packing box (not shown) when not in use. The practice putting green 10 includes a putting mat 20, a wedge-shaped incline 22, a conventional golf cup 24 at which a practicing golfer 26 should aim, and simulated golf hazards 28, 30 which the golfer 26 should seek to avoid. By conventional golf cup is meant a substantially circular cup having dimensions approximating a regulation golf cup.

Figure 2:
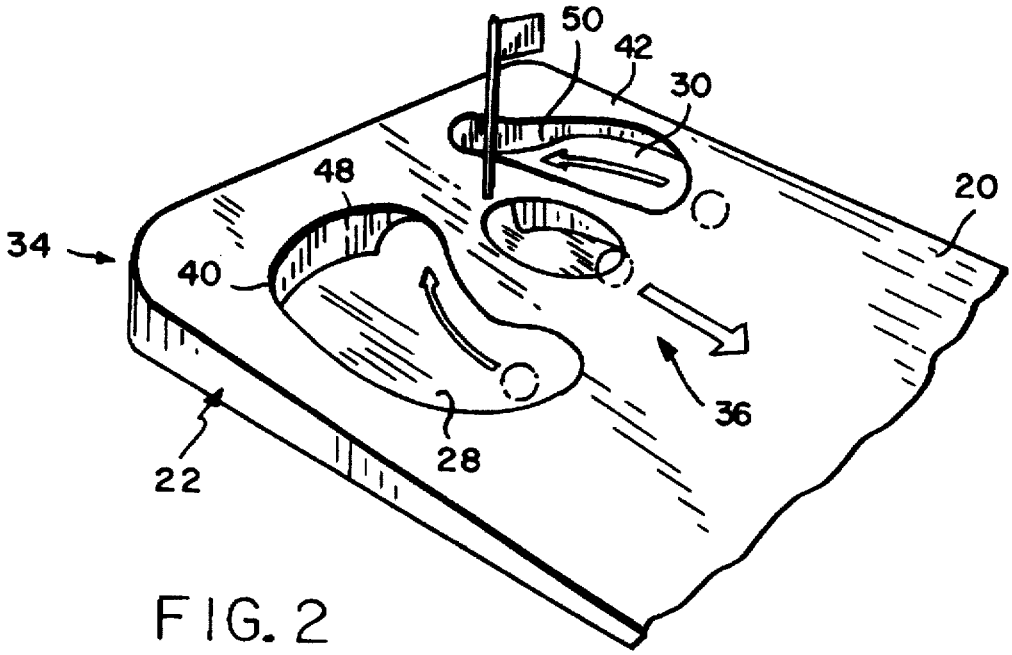
FIG. 2 is a perspective view of the practice putting green with simulated hazards showing the operation of a return mechanism in accordance with the present invention.
Figure 3:
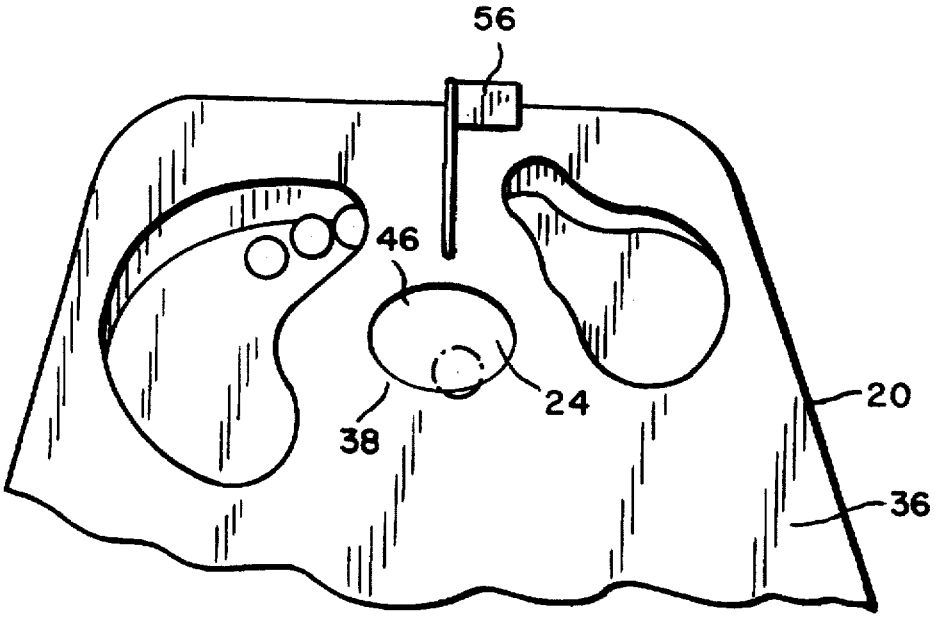
FIG. 3 is a perspective view of a distal end of the practice putting green with simulated hazards in accordance with the present invention.

The putting mat 20 is flexible and can be rolled or folded for compact storage. A suitable putting mat 20 is approximately nine feet long and approximately two feet wide. The putting mat 20 has a proximal end 32 and a distal end 34. As depicted in FIGS. 2 and 3, the putting mat 20 defines a putting surface 36 and a cup opening 38, a first hazard opening 40, and a second hazard opening 42. The putting surface 36 simulates the texture of the grass on a golf putting green and is made of green artificial grass or some other similar material. The openings 38, 40, 42 are proximate to the distal end 34.

Figure 6:
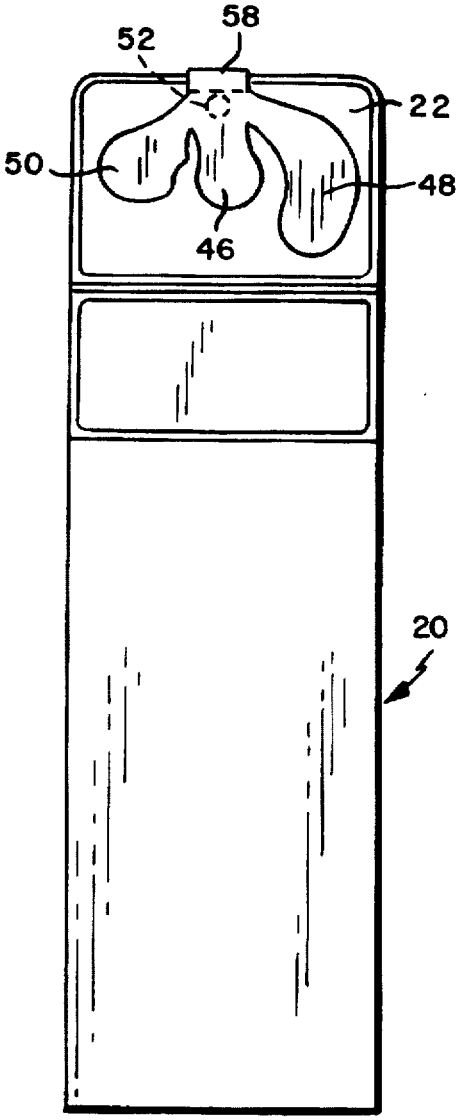
FIG. 6 illustrates a plan underside view in accordance with the present invention showing in hidden lines a golf ball resting place and a golf ball return mechanism.

The wedge-shaped incline 22 is tapered downwards towards the proximal end 32 and located underneath the distal end 34 of the putting mat 20. The incline 22 may comprise two sections or contain a hinging mechanism (not shown) for folding and thereby fostering compact storage. The incline 22 has a flat surface 44 (see FIG. 4) which is attached to and in contact with the putting mat 20. The incline may be made of any suitable structural material such as metal or wood. A molded plastic material is preferred. A cup cavity 46, a first hazard cavity 48, and a second hazard cavity 50 are provided in the flat surface 44 of the incline 22 as by molding. Referring to FIG. 6 which shows the underside of the practice putting green 10, the cavities 46, 48, 50 are formed such that they communicate underneath the flat surface 44 of the incline 22. The communicating cavities 46, 48, 50 slope towards the distal end 34 and form a resting place 52 shaped to contain a golf ball 54 and allow the ball 54 to come to rest below the plane of flat surface 44.

Figure 4:
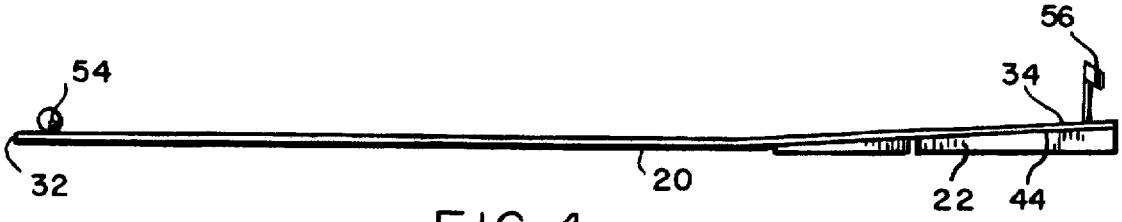
FIG. 4 is a side view in accordance with the present invention.
Figure 5:
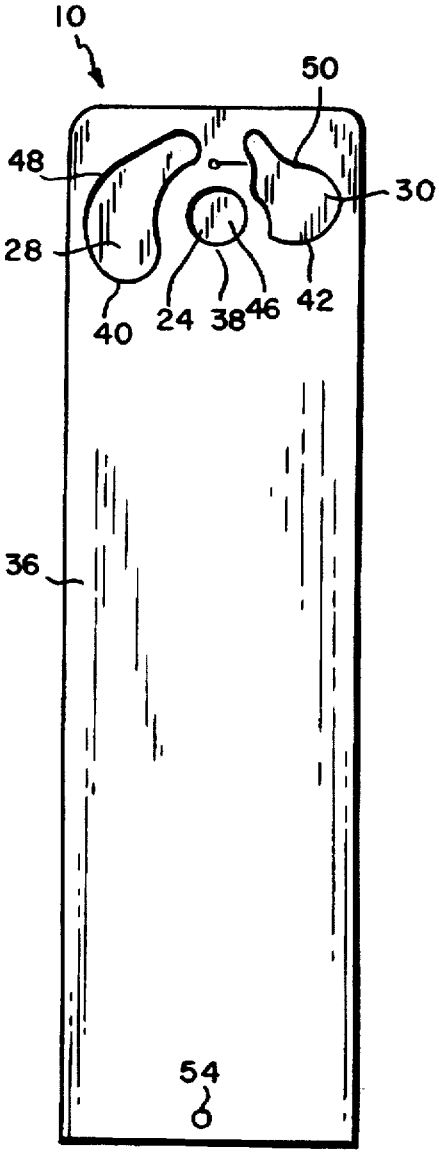
FIG. 5 illustrates a plan elevation view of the practice putting green in accordance with the present invention.

FIGS. 4 and 5 show that the conventional golf cup 24 having dimensions of a regulation golf cup is defined by the cup opening 38 being superimposed over the cup cavity 46. The primary object for the practicing golfer 26 is to putt the golf ball 54, from the proximal end 32 towards the distal end 34 and into the golf cup 24 located proximate to the distal end 34. The golf ball that successfully falls into the golf cup 54 will come to rest at the resting place 52.

A simulated golf water hazard 28 is defined by the first hazard opening 40 being superimposed over the first hazard cavity 48. The shape of the water hazard 28 is the shape of a miniature pond or other miniaturized water hazard found on a typical golf course. To add further realism, the color of the simulated hazard 28 is blue.

A simulated golf sand hazard 30 is defined by the second hazard opening 42 being superimposed over the second hazard cavity 50. The shape of the sand hazard 30 is roughly the shape of a miniature sand trap. The sand hazard 30 has the color and texture of sand.

The golf cup 24 is located between the hazards 28, 30 such that the hazards 28, 30 protect the golf cup 24 while still allowing an accurately putted golf ball 54 to enter the golf cup 24. To further aid the golfer in aiming at the cup 24, a target flag 56 is located behind the golf cup 24, between the golf cup 24 and the distal end 34. An improperly aimed golf ball that enters one of the hazards 38, 30 will come to rest at the resting place 52. Likewise, an accurately aimed and putted golf ball that fails into the golf cup 24 will come to rest at the resting place 52. A return mechanism 58 is located at the resting place 52. The return mechanism 58 is commonly known to those skilled in the art, and is commercially available as an electrically powered spring device that is plugged into an electrical outlet. When a golf ball 54 comes to rest at the resting place 52, it is propelled by the return mechanism 58 through the golf cup 24 and back towards the proximal end 32. The return mechanism allows the golfer 26 to practice with the same golf ball 54 without having to walk to retrieve the golf ball 54.

While a preferred embodiment has been shown and described, it will be understood that it is not intended to limit the disclosure, but rather it is intended to cover all modifications and alternate methods falling within the spirit and the scope of the invention as defined in the appended claims.

I claim:

1. A golf practice putting green comprising:

a putting mat having a distal end, the putting mat defining a putting surface and a plurality of openings proximate to the distal end, the putting surface having a texture that simulates grass on a putting green;

a wedge shaped incline located underneath the distal end of the putting mat, the incline having a flat surface including a plurality of cavities, the cavities communicating with each other underneath the incline surface such that they form a resting place for a golf ball;

a conventional golf cup defined by one of the openings in the putting mat being superimposed over one of the cavities in the incline;

at least one noncircular simulated golf hazard defined by the remaining openings in the putting mat being superimposed over the remaining cavities in the incline, and whereby a putted golf ball that falls into either the cup or the hazard comes to rest at the resting place; and an electrically powered return mechanism located at the resting place such that when the putted golf ball comes to rest at the resting place the return mechanism propels the golf ball away from the distal end of the putting mat.

2. The golf practice putting green of claim 1 wherein three openings in the putting surface and three cavities in the incline define one golf cup and two golf hazards, the golf cup located between the hazards, and the hazards being a simulated water hazard and a simulated sand hazard.

3. The golf practice putting green of claim 1 further including a target flag behind the golf cup and between the golf cup and the distal end of the putting mat.

4. A golf practice putting green comprising:

a putting mat having an elevated end, the elevated end including at least two openings defining cavities, the cavities communicating with each other underneath the elevated end to form a resting place for a golf ball;

a golf cup defined by one of the openings in the putting mat being superimposed over one of the cavities;

at least one noncircular golf hazard defined by the remaining opening or opening in the putting mat being superimposed over the remaining cavity or cavities, whereby a putted golf ball that falls into either the cup or hazard comes to the resting place; and an electrically powered return mechanism located at the resting place such that when the putted golf ball comes to rest at the resting place the return mechanism propels the golf ball away from the elevated end of the putting mat.

* * * * *